US006426721B1

(12) United States Patent
Obara

(10) Patent No.: US 6,426,721 B1
(45) Date of Patent: Jul. 30, 2002

(54) PHASE CONTROL DEVICE AND SYSTEM FOR PHASED ARRAY ANTENNA

(75) Inventor: Noriaki Obara, Tokyo (JP)

(73) Assignee: Communications Research Laboratory, Tokyo (JP)

( * ) Notice: Subject to any disclaimer, the term of this patent is extended or adjusted under 35 U.S.C. 154(b) by 0 days.

(21) Appl. No.: 09/995,831

(22) Filed: Nov. 29, 2001

(30) Foreign Application Priority Data

Mar. 29, 2001 (JP) ..... 2001-094595

(51) Int. Cl.[7] ..... H01Q 3/22
(52) U.S. Cl. ..... 342/375; 342/372
(58) Field of Search ..... 342/375, 372, 342/368

(56) References Cited

U.S. PATENT DOCUMENTS 5,583,516 A * 12/1996 Lembo ..... 342/375
5,977,911 A * 11/1999 Green et al. ..... 342/375

FOREIGN PATENT DOCUMENTS

JP 9-215048 8/1997

* cited by examiner

*Primary Examiner*—Theodore M. Blum

(57) ABSTRACT

A phase control device to control an optical control phased array antenna includes a wavelength splitter to split an input optical signal having multiplexed wavelengths corresponding to at least the number of control units of the antenna elements to be controlled for each wavelength, the optical signal, a plurality of phase shifters with different amounts of phase shift to change the phase of the optical signal in accordance with an excitation distribution of antenna elements, an optical switch matrix to assign a required amount of phase shift to an output at each wavelength from the wavelength splitter in accordance with each wavelength to lead it to one of the plurality of phase shifters, and an optical multiplexer to multiplex the outputs from the plurality of phase shifters to output a multiplexed optical signal.

5 Claims, 7 Drawing Sheets

PHASE CONTROL DEVICE AND SYSTEM FOR PHASED ARRAY ANTENNA

BACKGROUND OF THE INVENTION

1. Field of the Invention

The present invention relates to a phase control device for a phased array antenna and its system, and more particularly to a phase control device for an optical control phased array antenna suitable for feeding power to a large plane expanded active phased array antenna that is mounted on a satellite or the like, and an optical control phased array antenna system.

2. Description of the Related Art

There is a rapidly expanding demand for the information communications, and the satellite communications will be increasingly more important in the future. To cope with the smaller ground stations and the large-capacity communications at high speed and in wide band, a satellite antenna tends to be larger size, and the use of a large-size plane expanding active phased array antenna as suitable for that purpose is considered.

The features of such a phased array antenna may include the flexible beam control by a phase shifter, the scanning ability of beam over wide angles, the mirror precision easily retained by the phase shifter for larger aperture and higher frequencies, and the enhanced efficiency with the trouble proof capability and reduced output of individual amplifiers, because of the high output amplifiers that can be distributed in the active array system.

A problem associated with the large-size plane expanding active phased array antenna is that it is very heavy because the feeding system consists of a waveguide or a coaxial cable. To solve this problem, an optical feeding system is conceived, whereby the feeding system is constituted of an optical component/optical fiber, making it possible to realize the small size and light weight.

A technique associated with it was proposed in an optical link for radio signal transmission to transmit a lightwave modulated with a radio signal between a radio collection and delivery station and a radio base station having a phased array antenna, in which the phased array antenna at the radio base station is enabled through the signal processing of lightwave itself (Japanese Patent Laid-Open No. 9-215048, "Optical Link for Radio Signal Transmission").

In this optical link for radio signal transmission, an optical signal having a plurality of wavelengths is modulated with a radio signal from the radio collection and delivery station to the radio base station, and a modulated lightwave with the plurality of wavelengths is subjected to a delay processing of lightwave itself for the excitation distribution control of antenna elements. The optical signal under the excitation distribution control is converted into an electrical signal, which is then distributed to each radiator. For reception, the lightwave is modulated with the radio signal received at the radio base station, and transmitted to the radio collection and delivery station for making the signal processing as lightwave itself to extract an excitation distribution given to an incidence unit.

In the conventional optical control phased array antenna (e.g., Japanese Patent Laid-Open No. 9-215048), a number of optical control phase shifting circuits represented by an optical delay path were required corresponding to the number of radiant elements to provide an excitation distribution for each radiant element of the array antenna.

Therefore, in the case where a large scale phased array antenna of hundreds to tens of thousands of elements are constituted, the size or weight of a group of phase shifting circuits corresponding to the number of radiant elements has less negligible effect on the entire system. Particularly, in the optical control phased array antenna mounted on the satellites demanding for the small size, light weight and high reliability, the weight or volume has a significant effect on the ability of satellite. Also, because a number of highly reliable components are required, the cost is increased.

Further, in the conventional technique, it was difficult to constitute a control circuit that can withstand the severe environments of the satellite antenna that is exposed to the outer space, because optical signal processing means (e.g., a phase control circuit) resides directly under the antenna.

SUMMARY OF THE INVENTION

The present invention has been achieved in the light of the above-mentioned problems, and it is an object of the present invention to provide a phase control device for an optical control phased array antenna and an optical control phased array antenna system employing the phase control device, in which the number of circuits for phase control is reduced to make the phase control circuit smaller, lighter and simpler in the entire antenna system, even when a large scale phased array antenna is made up.

The phase control device to control the optical control phased array antenna according to the present invention is employed to control the optical control phased array antenna. The phase control device includes a wavelength splitter to split an input optical signal having wavelengths corresponding to at least the number of control units of the antenna elements to be controlled for each wavelength, a plurality of phase shifters with different amounts of phase shift to change the phase of the optical signal in accordance with an excitation distribution of antenna elements, an optical switch matrix to assign a required amount of phase shift in accordance with each wavelength to lead an output at each wavelength from the wavelength splitter to one of the plurality of phase shifters, and an optical multiplexer to multiplex the outputs from the plurality of phase shifters to output a multiplexed optical signal.

Also, an optical control phased array antenna system according to the present invention has an antenna in which n2 ($n2 \leqq 1$) subarray units consisting of n1 ($n1 \geqq 2$) control units of antenna elements are arranged. The optical control phased array antenna system includes, one or a plurality of light sources to output a lightwave having at least nl kinds of wavelengths multiplexed, m2 ($m2 \geqq m1$) optical modulators to modulate the lightwave having the n1 kinds of wavelengths with m1 ($m1 \geqq 1$) kinds of transmitting signal, m2 splitters to split an output light from the m2 optical modulators into n2, m2×n2 phase control devices to control the optical control phased array antenna to input the outputs from the m2 splitters, m2×n2 optical transmission lines to transmit an optical signal with n1 kinds of wavelengths multiplexed that are output from the m2×n2 phase control devices to control the optical control phased array antenna, m2×n2 band splitters to split an optical signal supplied via the m2×n2 optical transmission lines into n1 kinds for each wavelength, and n1×n2 optical multiplexers to multiplex m2 kinds of optical signals having different wavelengths corresponding to the outputs from the m2 optical modulators among the optical signals output from the m2×n2 band splitters to supply a multiplexed optical signal to each of the n1 control units in the n2 subarray units.

In this present invention, for an N-bit phase shifter with $2^N$ kinds of optical delay line optical path, for example, the optical switch matrix is employed to switch the optical path for each wavelength to assign the amount of phase shift. Accordingly, each optical delay line can be commonly utilized at different wavelengths. Therefore, the phase shifters in the phase control circuit can be reduced in number by the multiplicity of wavelengths as compared with the conventional technique.

DETAILED DESCRIPTION OF THE PREFERRED EMBODIMENTS

The preferred embodiments of the present invention will be described below in detail by reference to the accompanying drawings.

Figure 1:
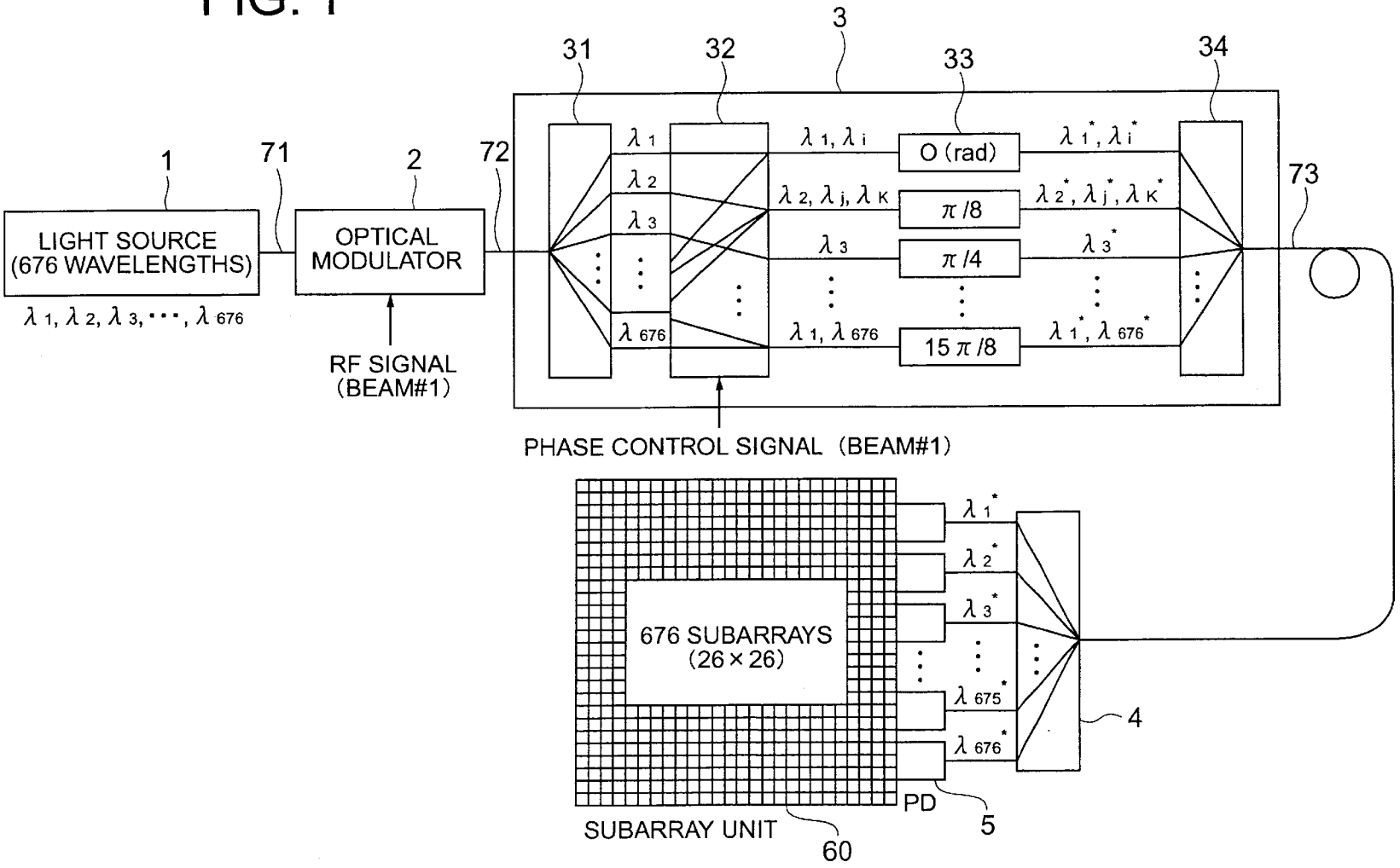
FIG. 1 is a view showing a basic configuration of an optical control phased array antenna (transmission system) using the present invention.

FIG. 1 is a view showing a basic configuration of an optical control phased array antenna (transmission system) using the present invention. In FIG. 1, the component parts of a circuit for forming one beam (beam #1) are particularly shown.

A light source 1 emits a lightwave having 676 wavelengths from $\lambda_1$ to $\lambda_{676}$ multiplexed to an optical fiber 71. An optical modulator 2 modulates the intensity of the lightwave having 676 wavelengths with a radio frequency (RF) transmitting signal. An intensity modulated optical signal is led through an optical fiber 72 to a phase control device 3.

In the phase control device 3, a band splitter 31 splits an optical signal sent through the optical fiber 72 into 676 optical signals having the wavelengths from $\lambda_1$ to $\lambda_{676}$. An optical switch matrix 32 switches the optical path for 676 optical signals upon a phase control signal for forming the beam (beam#1) to lead these optical signals to 16 RF band phase shifters 33 with different shifting amounts to give a delay (phase shift) to these optical signals in accordance with an excitation distribution of antenna elements.

Each of the RF band phase shifters 33 is constituted of an N-bit phase shifter with $2^N$ kinds or 4-bit phase shifter with $2^4$ (=16, N=4) kinds of optical delay line optical path, for example, giving a phase shift of a phase difference 0 radian in RF band to an optical signal of wavelength $\lambda_1$ and $\lambda_i$, giving a phase shift of a phase difference $\pi/8$ radian in RF band to an optical signal of wavelength $\lambda_2$, $\lambda_j$ and $\lambda_k$, and giving a phase shift of a phase difference $15\pi/8$ radian in RF band to an optical signal of wavelength $\lambda_1$ and $\lambda_{676}$. That is, by leading the optical signals output from the band splitter 31 via the optical switch matrix 32 to the RF band phase shifters 33, the optical delay lines are commonly used at different wavelengths. In the following, the wavelength under the phase control is denoted with a suffix "*" appended such as "$\lambda_i$*".

The outputs from the RF band phase shifters 33 are input into an optical multiplexer (or optical combiner) 34 for synthesis, multiplexed and output into one optical fiber 73. A multiplexed optical signal is led through an optical fiber 73 to a wavelength splitter 4 to split into wavelengths, and split optical signals are output to a photoelectric conversion unit (PD) 5 provided for each subarray that is a control unit of antenna elements.

One subarray unit 60 consists of 26=26×676 subarrays and is fed and excited by the photoelectric conversion unit 5 associated with it.

In particular, the band splitter 31, the light matrix switch 32, the RF band phase shifters 33, and the optical multiplexer 34 are made up as one integral circuit unit, thereby constituting the phase control device 3 that can be easily handled and is suitable for the mass production.

FIG. 2 shows a configuration example of an antenna array in the embodiment of the present invention. Though the component parts of the circuit for forming one beam (beam#1) have been described in FIG. 1, it is supposed that the optical control phased array antenna as described below controls the directivity of 50 beams.

Figure 2A:
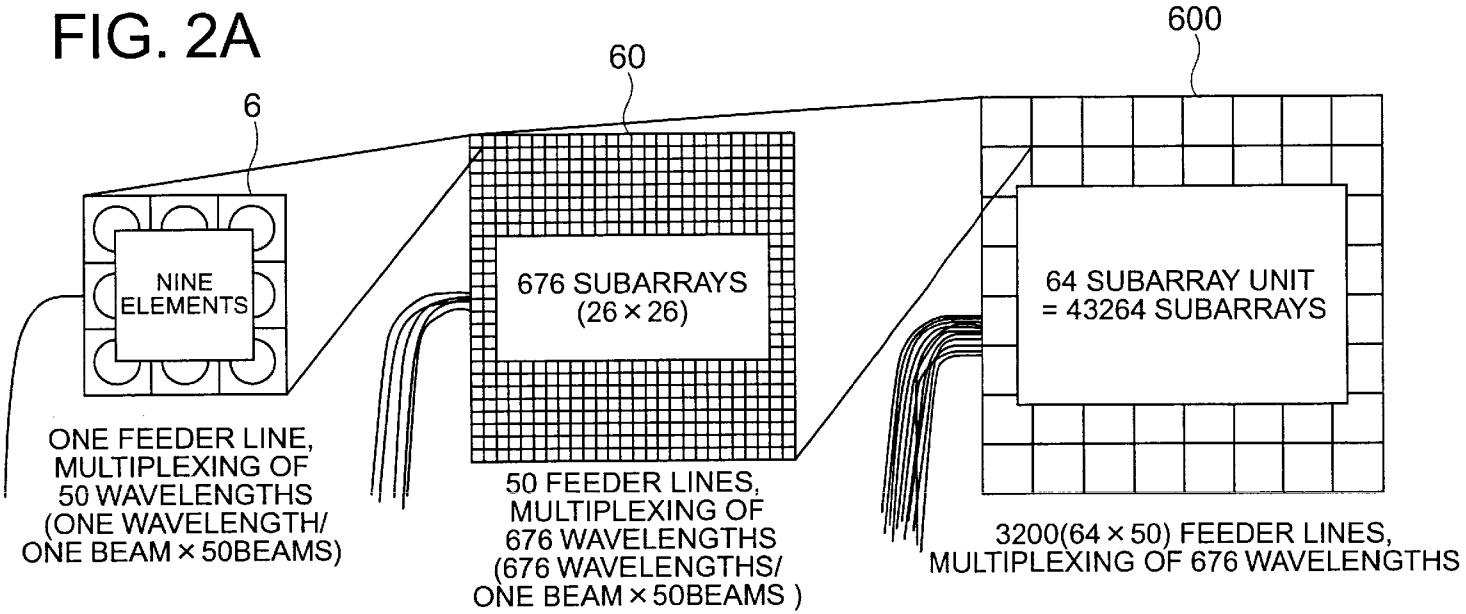
FIGS. 2A and 2B are views showing a configuration example of an antenna array in an embodiment of the present invention.

The antenna element is a micro-strip antenna, in which one subarray 6 is made up of nine elements, as shown in FIG. 2A. One subarray 6 is fed by one optical fiber, with one wavelength for each beam, in which an optical signal with 50 wavelengths multiplexed is employed for feeding 50 beams.

A subarray unit 60 is made up of 26=26×676 subarrays 6, and controlled by 50 feeder lines each with 676 wavelengths multiplexed.

An entire antenna panel 600 is constituted of 8×8=64 subarray units 60, that is, subarrays 6 as many as 676×64=43264, and controlled by 64×50=3200 feeder lines each with 676 wavelengths multiplexed.

Figure 2B:
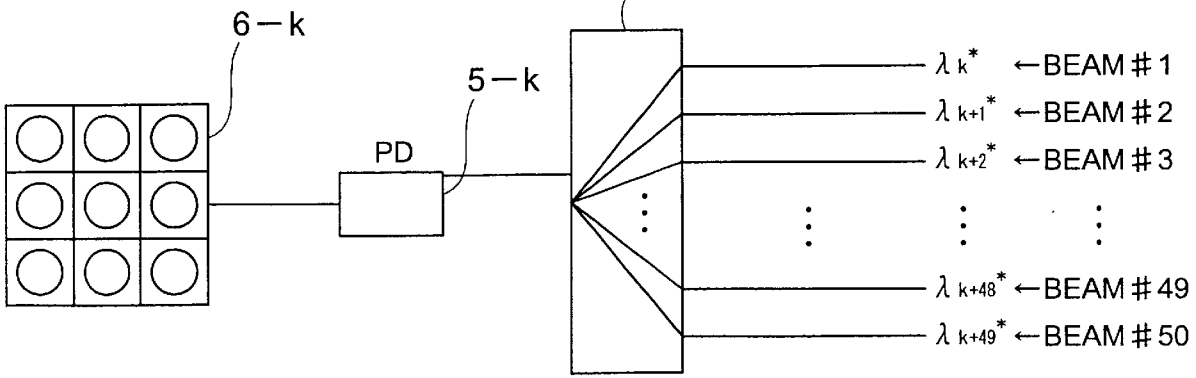

Noting the k-th subarray 6-k, an optical signal with the wavelength $\lambda_k$* is assigned as beam #1, the wavelength $\lambda_{k+1}$* as beam #2, . . . , and the wavelength $\lambda_{k+49}$* as beam #50 for each of 50 beams, and the optical signals with these wavelengths are multiplexed by the optical multiplexer 9-k, and converted into an electrical signal by the photoelectric converter 5-k to excite the k-th subarray 6-k, as shown in FIG. 2B.

As described above, one subarray unit 60 is fed by 676 wavelengths multiplexed per beam, in which one wavelength per beam (50 wavelengths for 50 beams in total) is assigned to each subarray 6. One subarray 6-k (one photoelectric converter 5-k) is fed by 50 wavelengths for 50 beams, in which the wavelength for feeding is shifted by one channel to avoid overlapping of the wavelengths between beam signals.

Figure 3:
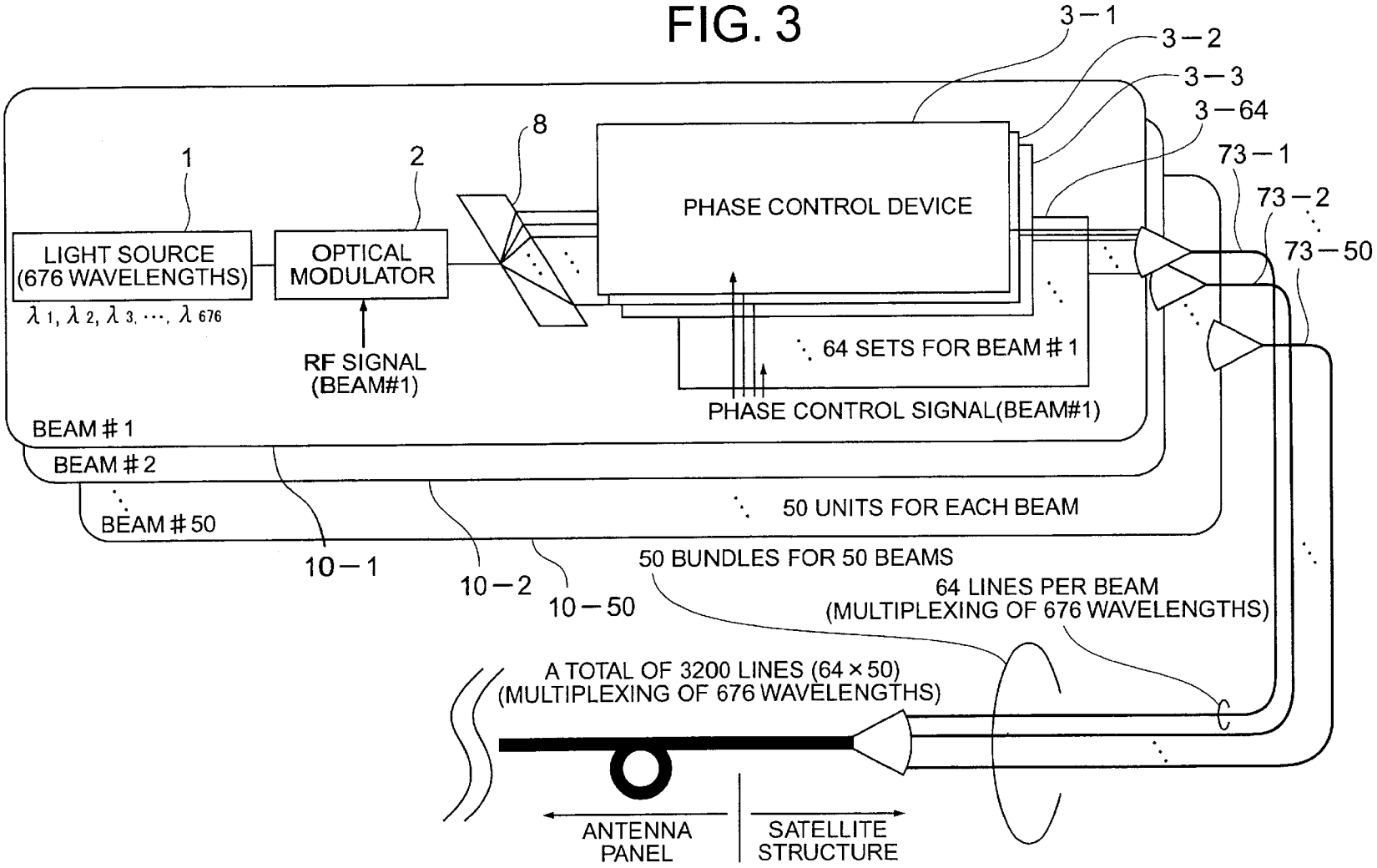
FIG. 3 is a view showing a configuration example of a portion of the optical control phased array antenna (transmission system) that is installed within a satellite structure in the embodiment of the present invention.

FIG. 3 is a view showing a configuration example of a portion of the optical control phased array antenna (transmission system) according to the embodiment of the present invention, which is installed within the satellite structure.

A unit 10-i (i=1, 2, . . . , 50) for controlling the phase is provided corresponding to each of the beams #1 to #50. One unit 10-i is composed of the light source 1 for emitting a lightwave having 676 wavelengths as described in FIG. 1, the optical modulator 2 to modulate the intensity of optical signal with an RF signal corresponding to each beam, a splitter 8 to split an output light from the optical modulator 2 into 64, corresponding to 64 subarray units 60 as described in FIG. 2, and 64 sets of phase control devices 3-j (j=1, 2, . . . , 64) having the band splitter 31, the optical switch matrix 32, the RF band phase shifters 33 and the optical multiplexer 34 as described in FIG. 1. The light source 1 can be also commonly utilized among the beams.

An output light from the phase control device 3-j is passed through 64 optical fibers 73-i per beam from the satellite structure to the antenna panel. For 50 beams in total, 3200 optical fibers in total are used. Optical signals with 676 wavelengths are multiplexed into one optical fiber.

Figure 4:
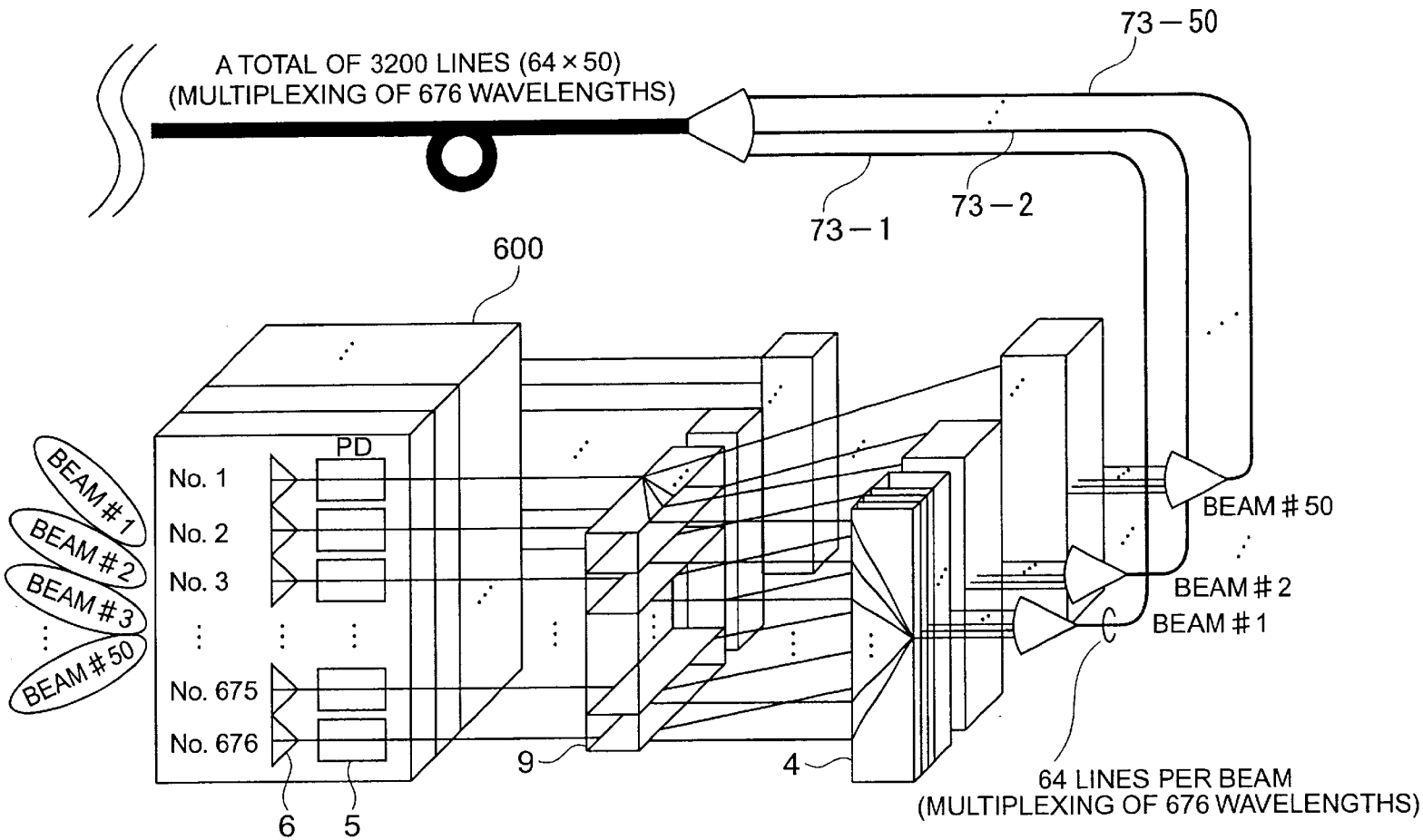
FIG. 4 is a view showing a configuration example of the optical control phased array antenna (transmission system) on the side of an antenna panel in the embodiment of the present invention.
Figure 5:
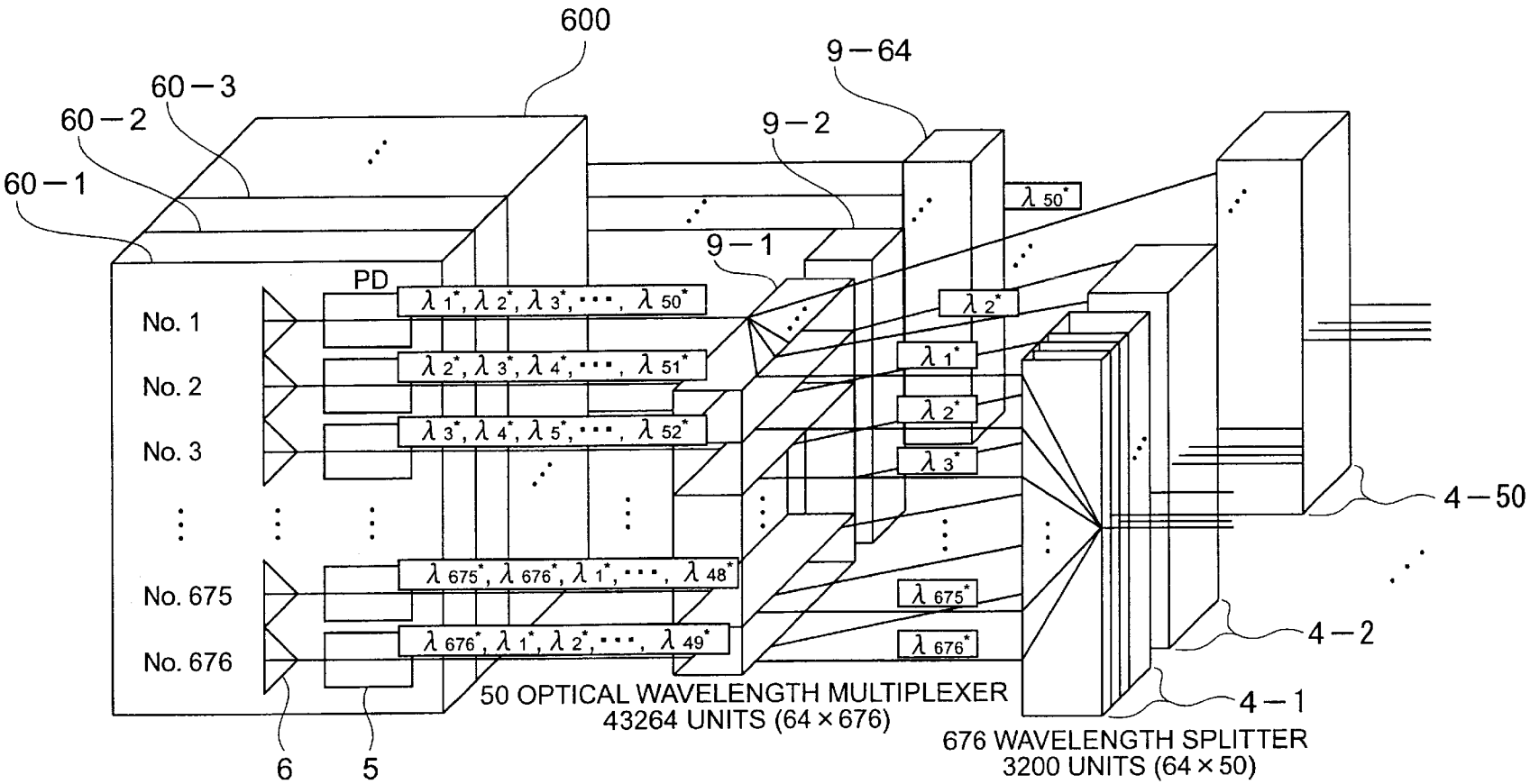
FIG. 5 is a partial enlarged view of FIG. 4.

FIGS. 4 and 5 show a configuration example of the optical control phased array antenna (transmission system) according to the embodiment of the present invention on the antenna panel side. FIG. 5 is an enlarged view of the essence of FIG. 4.

An optical signal with 676 wavelengths multiplexed is supplied to the band splitter 4 on the side of the antenna panel through 64 optical fibers 73-i (i=1, 2, . . . , 50) per beam. The band splitter 4 consists of 64 sets of 676 band splitters 4-i (i=1, 2, . . . , 50) for each of beam#1 to beam #50, one band splitter sending optical signals split into 676 wavelengths $\lambda_1^*, \lambda_2^*, \ldots, \lambda_{676}^*$ for each optical fiber to the optical multiplexer 9, as shown in FIG. 5.

The optical multiplexer 9 consists of 676 sets of 50 optical wavelength multiplexers 9-j (j=1, 2, . . . , 64) for each subarray unit 60-j (j=1, 2, . . . , 64), one optical wavelength multiplexer multiplexing optical signals with 50 wavelengths sent from each 676 band splitter 4-i for output to the photoelectric converter 5 associated with one subarray 6 within the subarray unit 60-j, as shown in FIG. 5.

Figure 6:
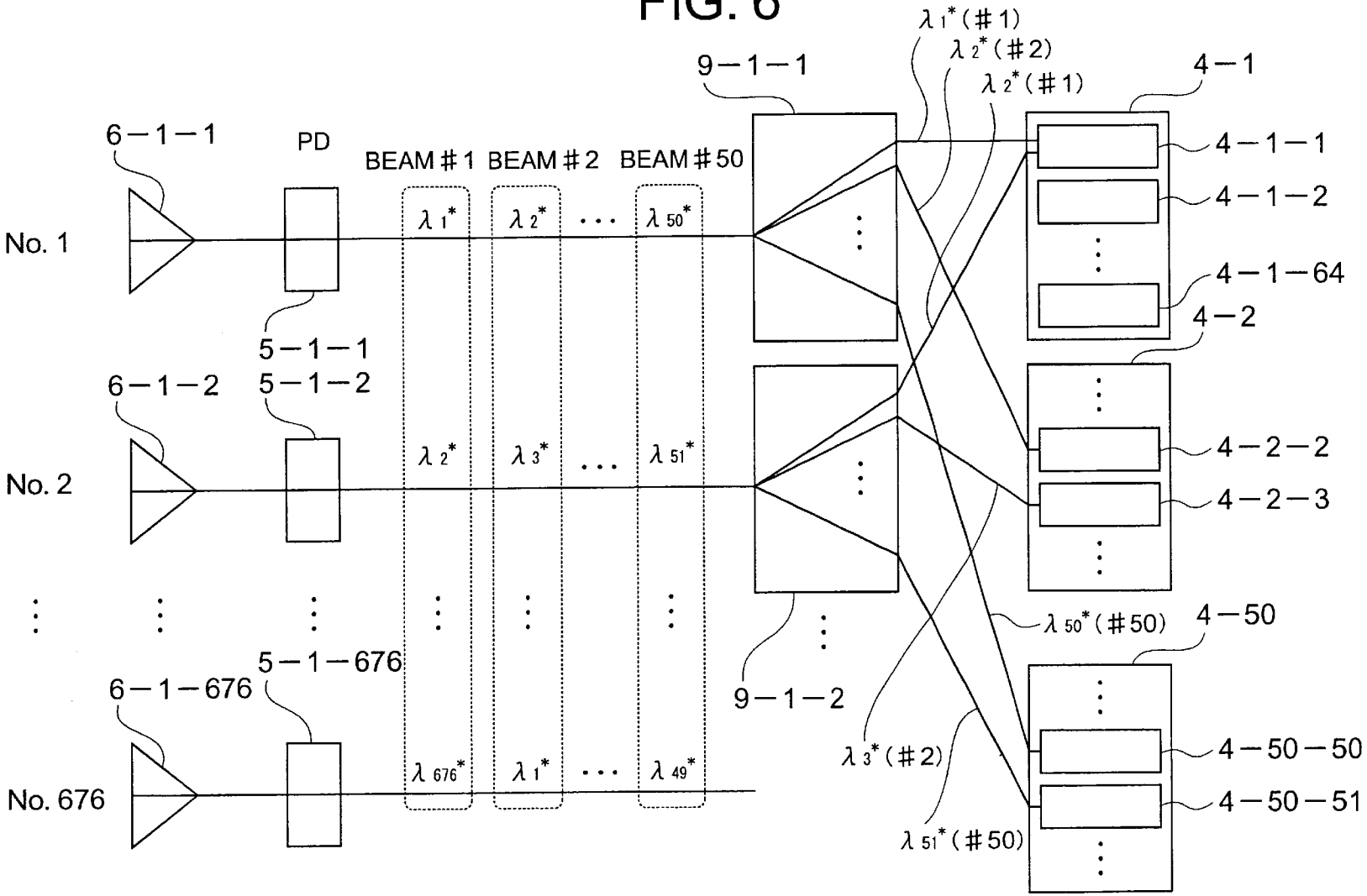
FIG. 6 is a view for explaining a way of splitting a wavelength.

Referring to FIG. 6, a method of splitting the wavelength in the configuration example as shown in FIGS. 4 and 5 will be described below. Each band splitter 4-i (i=1, 2, . . . , 50) corresponding to each beam consists of 64 sets of 676 band splitters 4-i-j (i=1, 2, . . . , 64), and each optical multiplexer 9-j (j=1, 2, . . . , 64) consists of 676 sets of 50 optical wavelength multiplexers 9-j-k (k=1, 2, . . . , 676).

Noting the first beam#1 specifically, the beam#1 is input into the band splitter 4-1 through 64 optical fibers 73-1, and an optical signal from each optical fiber is input into respective one of band splitters 4-1-1, . . . , 4-1-64. An optical signal with the first wavelength $\lambda_1^*$ split by the band splitter 4-1-1 is output to the optical multiplexer 9-1-1, an optical signal with the second wavelength $\lambda_2^*$ split by the band splitter 4-1-1 is output to the optical multiplexer 9-1-2, . . . , and an optical signal with the k-th wavelength $\lambda_k^*$ (k=1, 2, . . . , 676) is output to the optical multiplexer 9-1-k.

The optical multiplexer 9-1-1 has the inputs of an optical signal with the wavelength $\lambda_1^*$ regarding the beam#1 split by the band splitter 4-1-1, an optical signal with the wavelength $\lambda_2^*$ regarding the beam#2 split by the band splitter 4-2-2, . . . , and an optical signal with the wavelength $\lambda_i^*$ regarding the beam#i split by the band splitter 4-i-i (i=1, 2, . . . , 50), and synthesizes them by the optical multiplexer 9-1-1, whereby a multiplexed optical signal is input into the photoelectric converter 5-1-1 for the first subarray 6-1-1 of the subarray unit 60-1.

The photoelectric converter 5-1-2 for the second subarray 6-1-2 of the subarray unit 60-1 has the input of a multiplexed signal that is multiplexed by the optical multiplexer 9-1-2 from an optical signal with the wavelength $\lambda_2^*$ regarding the beam#1, an optical signal with the wavelength $\lambda_3^*$ regarding the beam#2, . . . , and an optical signal with the wavelength $\lambda_{i+1}^*$ regarding the beam#i.

As described above, a longitudinal array of wavelengths $\lambda_1^*, \lambda_2^*, \ldots, \lambda_{675}^*, \lambda_{676}^*$ at the input end of the photoelectric converter 5-1-k (k=1, 2, . . . , 676) corresponds to the first beam beam#1 signal, and a second longitudinal array of wavelengths $\lambda_2^*, \lambda_3^*, \ldots, \lambda_{676}^*, \lambda_1^*$ corresponds to the second beam beam#2 signal. In this way, by shifting the wavelength by one channel, it is possible to avoid overlapping of the wavelengths between beam signals.

If the adjustment for wavelength allocation is not made, several tens subarrays can be only controlled, as can be seen from the calculation of 676/50=13.52, at the time of controlling 50 beams with 676 wavelengths acquired from the light source 1. However, if the adjustment for wavelength allocation is made as described above, it is possible avoid overlapping of the wavelengths between beam signals, and control more subarrays.

Figure 7:
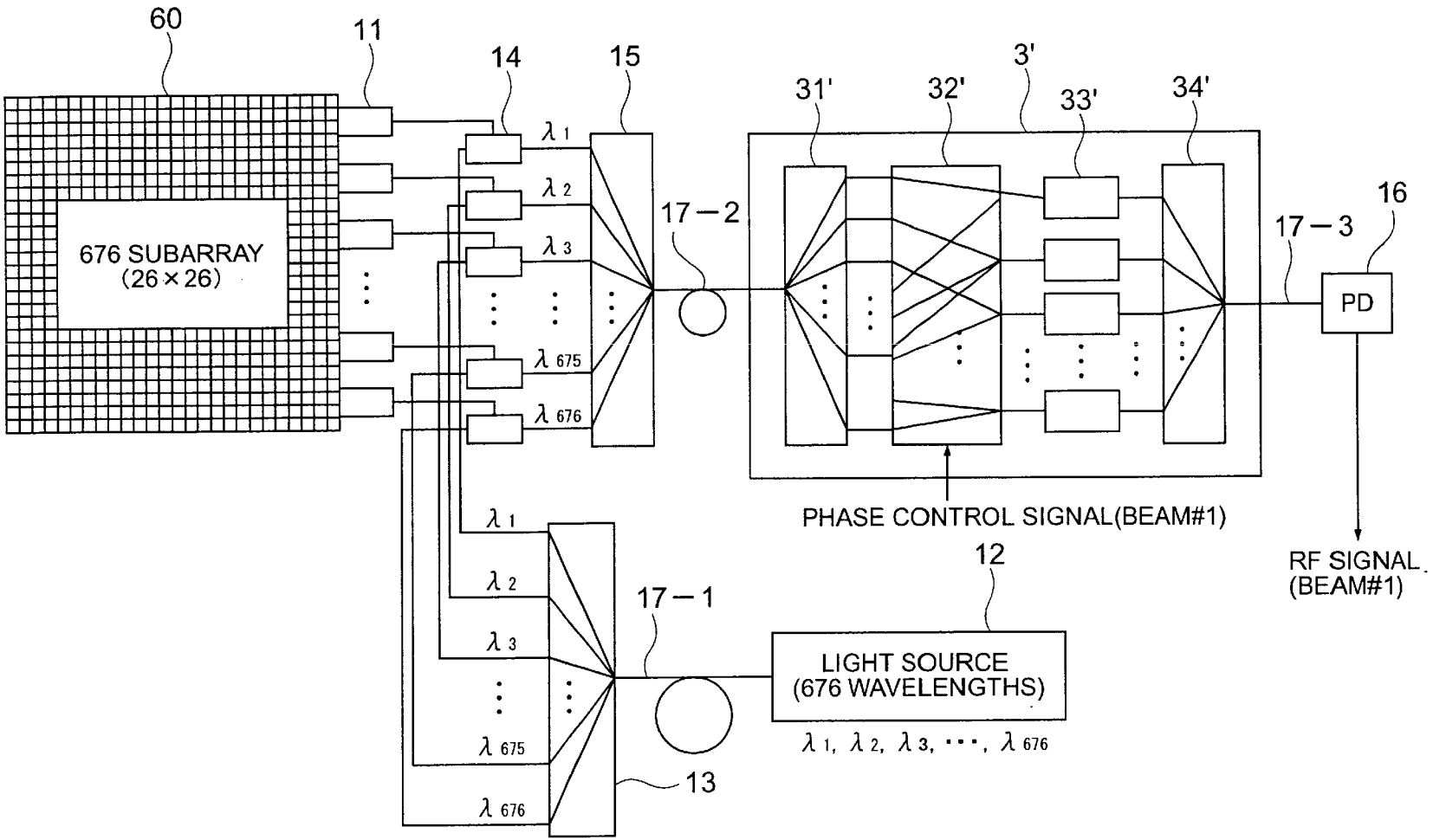
FIG. 7 is a view showing a basic configuration of the optical control phased array antenna (reception system) using the present invention.

FIG. 7 is a view showing a basic configuration of an optical control phased array antenna (reception system) using this present invention. In FIG. 7, the component parts of a circuit forming a reception system for one beam (beam #1) are shown in the same manner as in FIG. 1.

The subarray unit 60 constituting an antenna panel consists of 26×26=676 subarrays in the same manner as described with the transmission system. A received signal is amplified by a low noise amplifier 11, and input as an intensity modulating signal into the optical modulator 14.

On the other hand, the light source 12 emits a lightwave having 676 wavelengths from $\lambda_1$ to $\lambda_{676}$ multiplexed to an optical fiber 17-1. This lightwave is split into 676 lightwaves with the wavelengths from $\lambda_1$ to $\lambda_{676}$ by a band splitter 13, which are then input into the optical modulator 14. The optical modulator 14 modulates the intensity of the lightwaves with a signal received by the subarray unit 60 to send modulated signals to the optical multiplexer 15. The optical multiplexer 15 multiplexes the modulated optical signals having 676 wavelengths and sends a multiplexed optical signal to the optical fiber 17-2.

The optical signal output to the optical fiber 17-2 is led to a phase control device 3' provided within the satellite structure. The internal configuration of the phase control device 3' is the same as the phase control device 3 described by reference FIG. 1, and comprises a band splitter 31', an optical switch matrix 32', RF band phase shifters 33' with the optical delay lines, and an optical multiplexer 34'.

The band splitter 31' splits an optical signal sent through the optical fiber 17-2 into 676 optical signals with the wavelengths from $\lambda_1$ to $\lambda_{676}$. The optical switch matrix 32' switches the optical paths for 676 optical signals in accordance with a phase control signal corresponding to the received beam (beam#1) to lead the optical signals to 16 RF band phase shifters 33' with different shifting amounts to change the phase of these optical signals in accordance with an excitation distribution of antenna elements.

The optical signals with wavelengths under the phase control of the RF band phase shifters 33' are multiplexed by the optical multiplexer 34', and output to the optical fiber 17-3. This multiplexed optical signal is led to a photoelectric converter (PD) 16 for converting the optical signal into an electrical signal, whereby an RF signal of the received beam (beam#1) is extracted.

Though the configuration example of the reception system for one beam (beam#1) has been described by reference to FIG. 7, needless to say, it can be extended to the optical control phased array antenna capable of receiving plural beams in a plurality of subarray units exactly in the same way as the transmission system described by reference to FIGS. 2 to 6.

This present invention employs the configuration in which for the N-bit phase shifters with $2^N$ kinds of optical delay line optical path, an optical switch switches the optical path for each wavelength to allocate the phase shifting amount. In such a configuration, since each optical delay line can be commonly used at different wavelengths, the phase shifters in the phase control circuit can be reduced in number by the multiplicity of wavelengths as compared with the conventional technique. Also, since the control for all the wavelengths can be made by one or a few optical switch elements, the distribution of the control signal line can be simplified.

Also, by assigning one wavelength without overlapping others (m wavelengths when forming m beams) to one antenna element, it is unnecessary to place optical signal processing means (phase control circuit, etc.) directly under the antenna, whereby the control circuit can be disposed at a site away from the antenna with a smaller number of light feeding lines. In the application to the satellite, the control circuit can be disposed within the satellite structure, whereby the reliability of the device is improved.

What is claimed is:

1. A phase control device to control an optical control phased array antenna, the device comprising:

a wavelength splitter to split an input optical signal with wavelengths corresponding to at least the number of control units of antenna elements to be controlled for each wavelength;

a plurality of phase shifters with different amounts of phase shift to change the phase of the optical signal in accordance with an excitation distribution of the antenna elements;

an optical switch matrix to assign a required amount of phase shift in accordance with each wavelength to lead an output at each wavelength from the wavelength splitter to one of the plurality of phase shifters; and an optical multiplexer to multiplex the outputs from the plurality of phase shifters to output a multiplexed optical signal.

2. A phase control device according to claim 1, wherein the plurality of phase shifters comprise an N-bit phase shifter with $2^N$ kinds of optical delay line optical path.

3. An optical control phased array antenna system having an antenna in which n2 (n2≧1) subarray units consisting of n1 (n1≧2) control units of antenna elements are arranged, the system comprising:

one or a plurality of light sources to output a lightwave having at least n1 kinds of wavelengths multiplexed;

m2 (m2≧m1) optical modulators to modulate the lightwave having the n1 kinds of wavelengths with m1 (m1≧1) kinds of transmitting signal;

m2 splitters to split an output light from the m2 optical modulators into n2;

m2×n2 phase control devices to input the outputs from the m2 splitters;

m2×n2 optical transmission lines to transmit an optical signal with n1 kinds of wavelengths multiplexed that are output from the m2×n2 phase control devices;

m2×n2 band splitters to split an optical signal supplied via the m2×n2 optical transmission lines into n1 kinds for each wavelength; and n1×n2 optical multiplexers to multiplex m2 kinds of optical signals having different wavelengths corresponding to the outputs from the m2 optical modulators among the optical signals output from the m2×n2 band splitters to supply a multiplexed optical signal to each of the n1 control units in the n2 subarray units, wherein the phase control device further comprises:

a wavelength splitter to split an input optical signal with wavelengths corresponding to at least the number of control units of the antenna elements to be controlled for each wavelength;

a plurality of phase shifters with different amounts of phase shift to change the phase of the optical signal in accordance with an excitation distribution of antenna elements;

an optical switch matrix to assign a required amount of phase shift in accordance with each wavelength to lead an output at each wavelength from the wavelength splitter to one of the plurality of phase shifters; and an optical multiplexer to multiplex the outputs from the plurality of phase shifters to output a multiplexed optical signal.

4. An optical control phased array antenna system according to claim 3, wherein the m2×n2 band splitters and the n1×n2 optical multiplexers adjust wavelength allocation to avoid overlapping of wavelengths among the ml kinds of transmitting signals, and wherein an optical signal with the wavelength shifted periodically between control units is supplied to each of the control units of antenna elements.

5. An optical control phased array antenna system according to claim 3, wherein the plurality of phase shifters comprise an N-bit phase shifter with $2^N$ kinds of optical delay line optical path.

* * * * *